US005137220A

United States Patent [19]

Rose et al.

[11] Patent Number: 5,137,220

[45] Date of Patent: Aug. 11, 1992

[54] MOUNTING APPARATUS FOR IMPELLER FOR A CENTRIFUGAL IMPACT CRUSHER

[75] Inventors: Brett M. Rose, Vancouver; William F. Burr, Ridgefield, both of Wash.; Stephen B. Ackers, Portland, Oreg.

[73] Assignee: Canica Crushers, Inc., Vancouver, Wash.

[21] Appl. No.: 821,856

[22] Filed: Jan. 15, 1992

Related U.S. Application Data

[63] Continuation of Ser. No. 680,439, Apr. 4, 1991, abandoned.

[51] Int. Cl.[5] ..... B02C 19/00

[52] U.S. Cl. ..... 241/275; 198/642

[58] Field of Search ..... 241/275; 198/642

[56] References Cited

U.S. PATENT DOCUMENTS

| | | | |
|---|---|---|---|
| 2,310,758 | 2/1943 | Werner et al. | 241/275 |
| 4,397,426 | 8/1983 | Warren et al. | 241/275 |
| 4,940,188 | 7/1990 | Rodriguez et al. | 241/275 |

FOREIGN PATENT DOCUMENTS

| | | | |
|---|---|---|---|
| 523063 | 7/1940 | United Kingdom | 241/275 |
| 2198060 | 6/1988 | United Kingdom | 241/275 |

*Primary Examiner*—Mark Rosenbaum
*Assistant Examiner*—John M. Husar
*Attorney, Agent, or Firm*—Chernoff, Vilhauer, McClung & Stenzel

[57] ABSTRACT

An apparatus for mounting impeller blocks to the turntable of a centrifugal impact crusher is provided. Each block defines a bore that extends between its forward and back faces, with the bore including an enlarged cavity region in communication with the forward face of the block. The head portion of an elongate bolt is seated within the enlarged cavity region, with a threaded portion of the bolt projecting from the back face of the block for insertion through an opening formed in an upright mount which is joined to the turntable. A fastener engages the threaded portion to releasably hold the block against the upright mount. The head portion of the bolt includes a wedge section that is radially asymmetrical about the center axis of the bolt for preventing rotation of the bolt within the bore during retightening of the fastener. The head portion of the bolt preferably includes a tapered section that converges toward the constant diameter threaded portion of the bolt for controlling knock between the block and the bolt or bracket.

4 Claims, 3 Drawing Sheets

MOUNTING APPARATUS FOR IMPELLER FOR A CENTRIFUGAL IMPACT CRUSHER

BACKGROUND OF THE INVENTION

The present invention relates to the field of centrifugal impact crushers where a plurality of impeller blades are radially mounted adjacent the rim of a rapidly spinning horizontally-supported turntable. These impeller blades ensure that solid material thrown from the spinning turntable, such as rocks, are radially directed outwardly for breakage against anvils that are mounted on the walls of a surrounding container. More particularly, the present invention relates to an apparatus for mounting the impeller blades to the turntable.

In Ackers, U.S. Pat. No. 4,090,673, apparatus for mounting impeller blades to the turntable of a centrifugal impact crusher are shown. Each apparatus includes a bracket, fixedly joined to the turntable, having an upright mounting face in which an opening is formed. The impeller block, along the front of which the blade is formed, is positioned with its back against this mounting face so that a nub portion projecting from the back of the block is received through the opening formed in the mounting face. The impeller block is then detachably secured to the bracket by a pin which releasably slides through a hole formed in the nub portion thus preventing removal of the nub from the mounting face opening.

The above-described mounting apparatus has not, however, proven entirely satisfactory. As rocks or other subject material impinge on the impeller blade during rotation of the turntable, repeated jarring of the impeller block occurs. This, in turn, causes repeated knocking of the block and pin against the upright mounting face of the bracket so that cracks develop in the block, particularly in the nub portion and particularly with time a the hole in the nub portion broadens due to repeated impact with the pin. These cracks may eventually result in the block breaking free from the spinning turntable causing expensive damage to the crusher.

To overcome this problem, other mounting approaches have been tried, each with only partial success. One such approach relies on a pin having an enlarged wedge-shaped head, so that by driving the pin into the hole formed in the nub portion, the back of the block is firmly pressed against the mounting face of the bracket. Despite the initial tight-fit achieved, however, in a short time the pin tends to vibrate back out of the hole, again allowing play between the block and the upright face and possible failure.

Another approach tried has been to bolt the impeller block directly to the mounting face of the bracket using one or more bolts. This approach, however, presents its own difficulties. Due to the heavy wear experienced at the forward face of the impeller, which is sufficient in degree to eventually carve out a deep concave depression in the specially-hardened block, if the relatively softer bolt is run entirely through the block with its head forwardly emerging, the head will quickly wear off causing the block to be thrown from the turntable. Although it would appear that this problem could be readily solved by placing the bolts in threaded bores in the block, in practice, because the block is a specially-hardened alloy that requires casting and is nonmachinable, dimensional matching of the bolt threads with the bore threads cannot consistently be obtained. Thus, the bolts work loose and ultimately fail. A more practical solution is to use heli coils to match the bolt threads, each selected for close seating within the bore that is formed in the particular chosen block, but even here the heli coils have a tendency to pull loose from their seated positions, under repeated jarring of the impeller blocks, eventually causing failure.

An object of the present invention, then, is to provide an improved apparatus for mounting impeller blocks on the turntable of a centrifugal crusher.

A further object of the present invention is to provide a mounting apparatus where repeated jarring or progressive wearing of the impeller blocks, by solid material placed on the turntable, is unlikely to crack the blocks or to cause release of the blocks from the spinning turntable with accompanying damage to the crusher.

A further object of the present invention is to provide an apparatus for mounting impeller blocks on the turntable that does not require the impeller blocks, which are casted of nonmachinable alloy, to be formed precisely to exact dimensional specifications.

SUMMARY OF THE PRESENT INVENTION

The present invention overcomes the above-described deficiencies of the prior art by providing an impeller block with an enlarged cavity region defined in the forward face of the block, as part of a bore that extends from the forward to back faces of the block. An elongate bolt having a threaded portion and an enlarged head portion is inserted through the bore so that the head seats within the enlarged cavity region and the threaded portion projects from the back face of the block for subsequent passage through an opening formed in the upright face of a turntable-mounted bracket. A fastener engaged with the threaded portion of the bolt then holds the block against the upright face. The enlarged cavity region of the block in cooperation with the enlarged head portion of the bolt prevent the block from being thrown from the turntable even if portions of the forward face of the block are worn away by repeated impact with rocks. Additionally, this mounting assembly serves to securely hold the block to the upright mount even when the diameter of the bore formed in the block is oversized relative to that of the constant diameter shank portion of the bolt. Should the fastener vibrate loose during operation of the crusher, the operator can easily retighten the fastener to prevent the block from knocking against the bracket or bolt and developing cracks.

Preferably, the enlarged head portion of the bolt includes a wedge section that is radially asymmetrical about an imaginary center axis of the bolt in a plane extending perpendicularly through the center axis. The wedge section enables turned engagement of the fastener onto the bolt, while preventing rotation of the bolt within the bore of the block, despite lack of access to the head portion of the bolt due to the collecting of rocks at the mouth of the enlarged cavity region.

Preferably, the enlarged head portion of the bolt further includes a tapered section that converges toward the constant diameter shank portion and reduces the likelihood of cracks developing in the block. Specifically, the tapered section enables the operator to incrementally control, by limiting the degree of disengagement of the fastener from the bolt, the maximum degree of lateral play available between the block and bracket, so that the forces acting on the block, upon lateral impact with the bracket, are minimized. Furthermore, by centering the constant diameter shank portion within the oversized bore even during partial disengagement of the fastener, the tapered section limits the forces acting on the block upon initial lateral impact with the bolt.

The foregoing and other objectives, features and advantages of the invention will be more readily understood upon consideration of the following detailed description of the invention, taken in conjunction with the accompanying drawings.

DETAILED DESCRIPTION OF THE INVENTION

Figure 1:
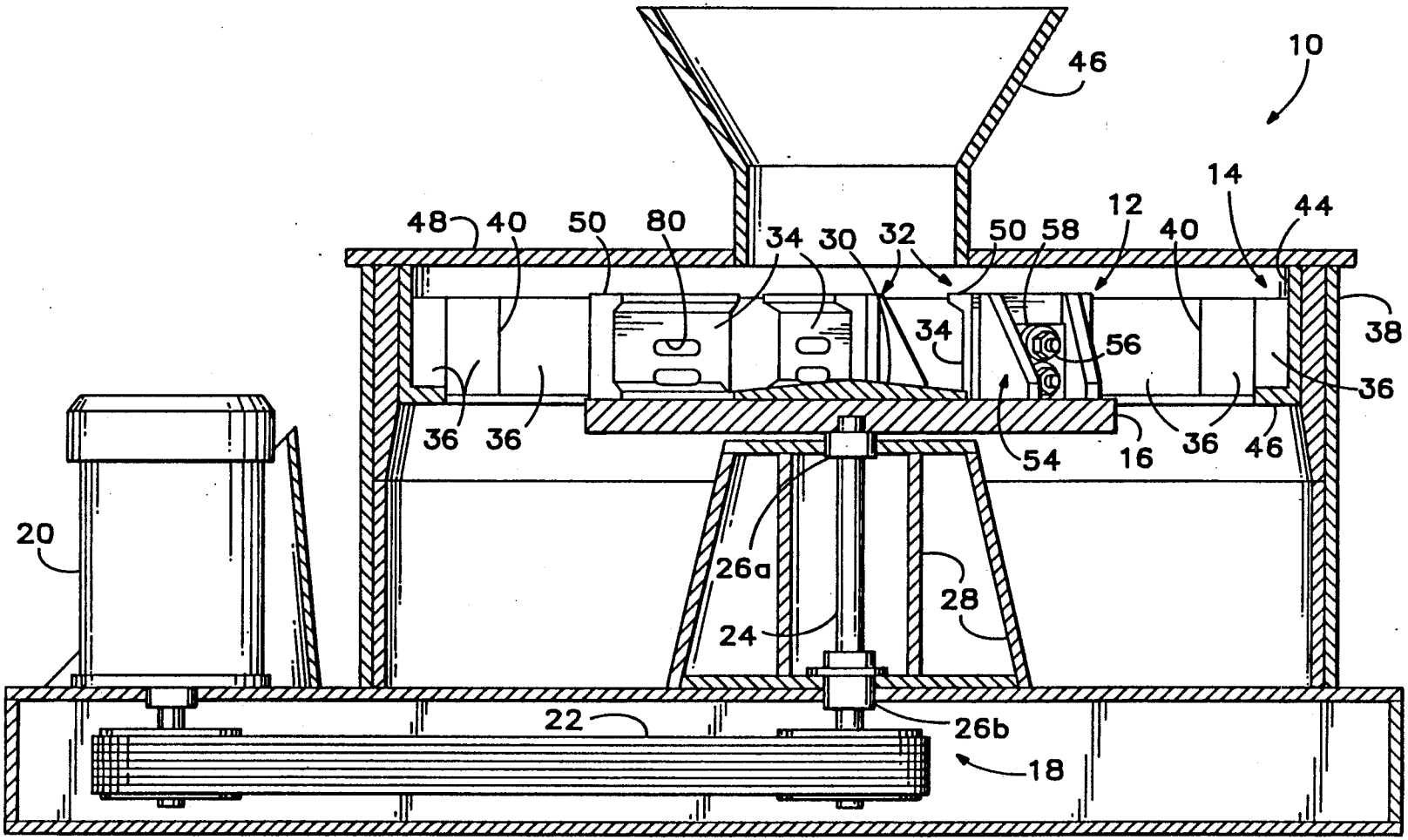
FIG. 1 is a side view, partially in section, showing an exemplary centrifugal impact crusher in accordance with the present invention.
Figure 2:
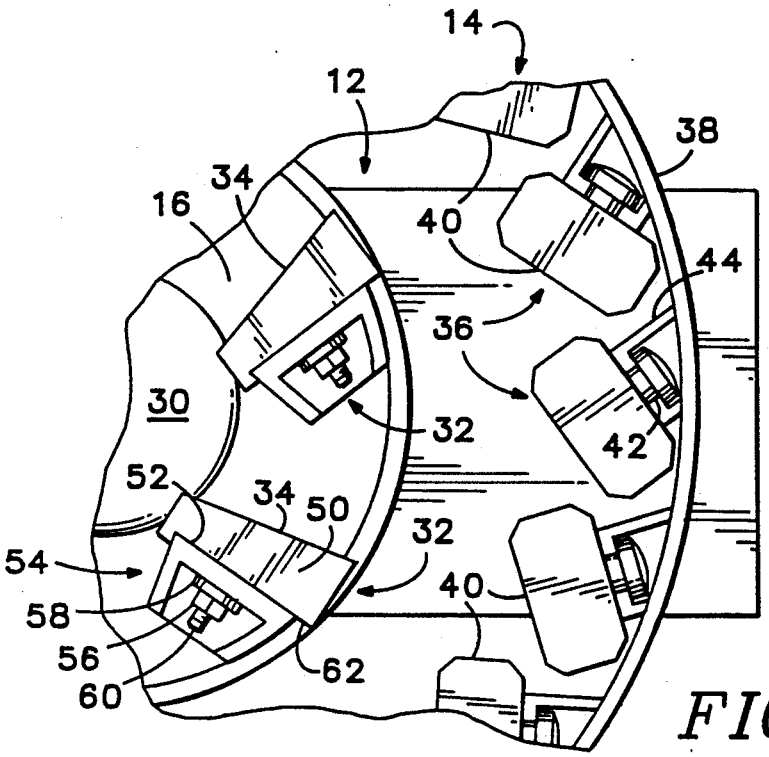
FIG. 2 is a fragmentary plan view of the crusher shown in FIG. 1.

Referring to FIG. 1, an exemplary centrifugal impact crusher 10 is shown, in accord with the present invention, for crushing rocks and other materials. The crusher 10 comprises a centrifugal launching assembly 12 and a breaker assembly 14. The centrifugal launching assembly 12 includes a turntable 16 rotatably driven in a horizontal plane by a drive assembly 18 comprising a motor 20, an endless belt 22, a turnshaft 24, and a pair of shaft supporting bearings **26*a* and 26*b* that are mounted at opposite ends of a pedestal support 28. The centrifugal launching assembly 12 further includes a raised conical centerpiece 30 concentrically mounted on the turntable 16 and a plurality of impeller assemblies 32, each including a forward face 34. The impeller assemblies are mounted, as shown in FIG. 2, in circumferentially-spaced relation about the periphery of the turntable 16 so that each respective forward face 34 extends in a generally radial direction that slightly undershoots the center of the turntable. The breaker assembly 14 includes a plurality of individual anvils 36 that are circumferentially mounted along the inner wall of a large cylindrical shell 38 so as to surround the centrifugal launching assembly 12. Each anvil 36 is conveniently releasably mounted to the shell 38 by sliding receival into an open-ended slot 42 formed on a bracket 44 joined to the shell 38**.

Operation of a centrifugal impact crusher, of the type above-described, is well understood in the art, and begins by dropping rocks or other material over the center of the rotatably driven turntable 16 by means of a center-drop mechanism such as a centering funnel 46 that is affixed to a lid member 48. The continuous spinning motion of the turntable 16 generates a radially-outward centrifugal force on the rocks that helps to draw them down the sloping sides of the conical centerpiece 30 and into the turntable 16. At some radial distance from the center of the turntable 16, each rock acquires sufficient tangential velocity to experience an outwardly-drawing centrifugal force which overcomes the frictional forces holding it to the turntable 16. When this occurs, the rock is propelled from the centrifugal launching assembly 12, in a substantially radial direction determined by the forward face 34 of the adjacent impeller assembly 32; and is broken up after striking an anvil 36. In this manner, rocks or other solid material introduced into crusher 10 are broken up or pulverized.

Referring to FIG. 2, each impeller assembly 32 includes an impeller block 50 which provides the forward face 34 of the impeller assembly. The impeller block 50 is detachably mounted to a bracket 54 that is permanently joined, as by welding, to the turntable 16. More specifically, referring also to FIG. 1, the block 50 is detachably held against an upright mounting face 52 of the bracket 54 by a pair of fasteners each including an elongate bolt 60, a nut 56 and an associated washer 58. As indicated in solid lines in FIG. 3, each elongate bolt 60 is securably received within and projects from the back face 62 of the block 50 through an opening 64 formed in the upright mounting face 52. This fastening arrangement facilitates replacement of the impeller block 50 after a significant portion of the forward face 34 has been worn away. Such wearing occurs over the course of normal operation of the crusher 10 due to repeated impingement of the forward face 34 by the rocks that are being crushed. To delay this wearing process somewhat, each impeller block 50 is preferably cast of chromium alloy or other suitably hard material.

Figure 5:
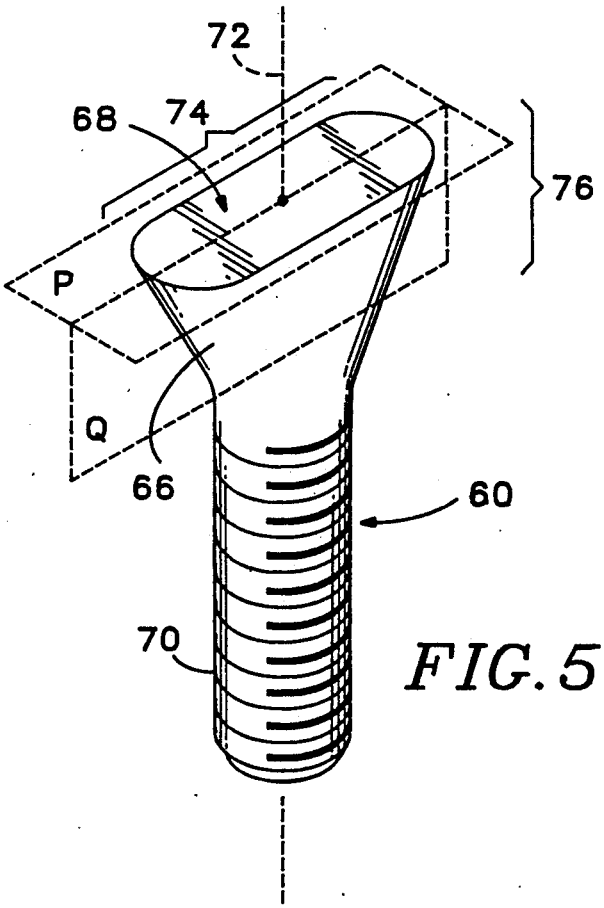
FIG. 5 is an enlarged perspective view of the endwise flared bolt of the impeller assembly shown in FIGS. 1-4.

Referring to FIG. 5, the elongate bolt 60 includes an enlarged head portion 66 formed entirely at a terminal end 68 of the bolt and a constant diameter externally-threaded shank portion 70 which defines an imaginary center axis 72 extending through the bolt. The head portion 66 includes a wedge section 74 that is radially asymmetrical about the center axis 72 in a plane P extending perpendicularly through the center axis. The wedge section 74 preferably has a flattened profile in plane P, as shown, but optionally may be rectangular or otherwise noncircular in profile. The head portion 66 further includes a tapered section 76 that has an endwise flared profile in a plane Q that includes the center axis 72. More specifically, the tapered section 76 preferably converges toward the constant diameter shank portion 70 so as to define a 45° angle with the imaginary center axis 72.

Figure 3:
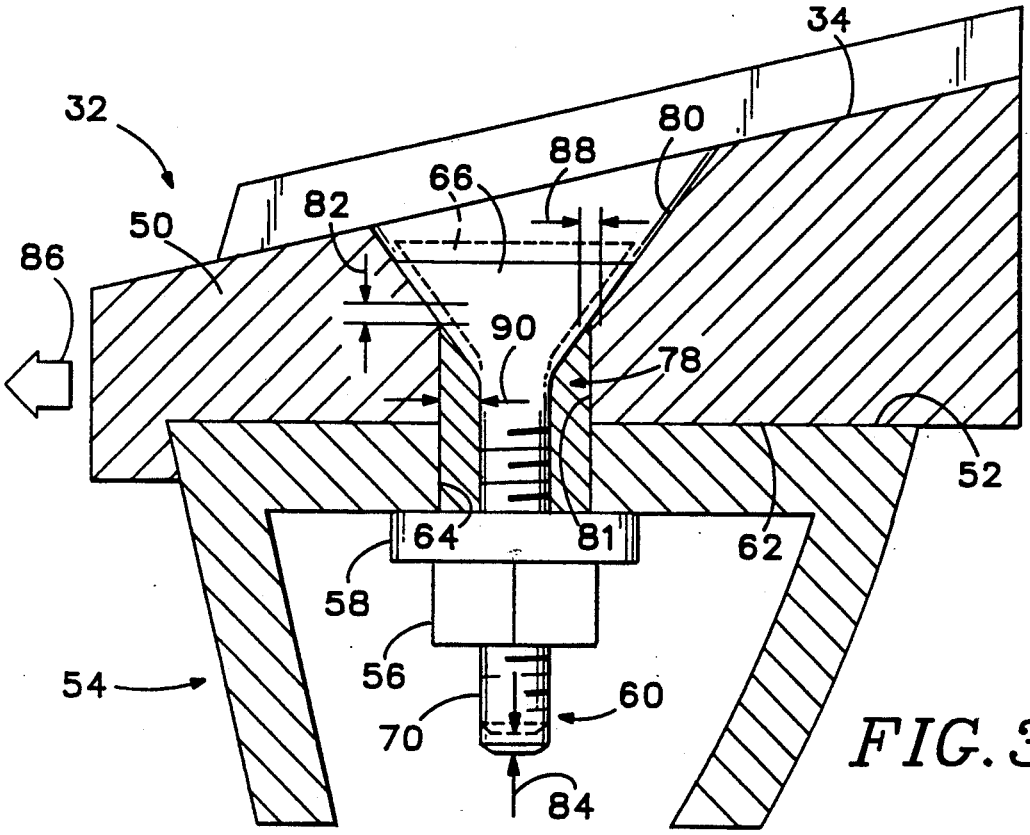
FIG. 3 is a sectional plan view, at an enlarged scale, of an individual one of the impeller assemblies shown in FIG. 2. Dashed lines indicate the forward play available from an endwise flared bolt loosely joining the impeller block to a bracket.

Referring to FIG. 3, a pair of bores 78 (one being visible) are defined in the impeller block 50 and extend between the forward face 34 and back face 62 of the block. Each bore 78 includes an enlarged cavity region 80 in communication with the forward face 34 and a constant diameter portion 81 extending between the enlarged cavity region 80 and the back face 62. As depicted, the enlarged cavity region 80 is formed with a shape that is generally complementary with that of the head portion 66 of the elongate bolt 60 and therefore includes inner walls that forwardly diverge at substantially a 45° angle as well as a flattened profile in a plane transverse to the bore 78 (refer to FIG. 1).

To mount the impeller block 50 to the bracket 54, the back face 62 of the block is set against the mounting face 52 of the bracket and the threaded portion 70 of the elongate bolt 60 is consecutively inserted through the bore 78 of the block and the opening 64 of the bracket.

The washer 58 is slipped over the threaded portion 70 and a nut 56 is threadably engaged with the threaded portion until impeller block 50 is pressed firmly against the bracket 54. As indicated in FIG. 3, this mounting technique enables forming of a tight connection between the block 50 and the bracket 54 even if the constant diameter portion 81 of the bore 78 is oversized in relation to the constant diameter shank portion 70 of the bolt 60. Indeed, by forming block 50 so as to obtain, on average, a moderately oversized relationship, a high yield can be achieved in the production of the impeller blocks 50, even if large variations in bore diameter exist from one production batch to another, and even if the material from which the block is cast becomes unworkable once hardened.

Figure 4:
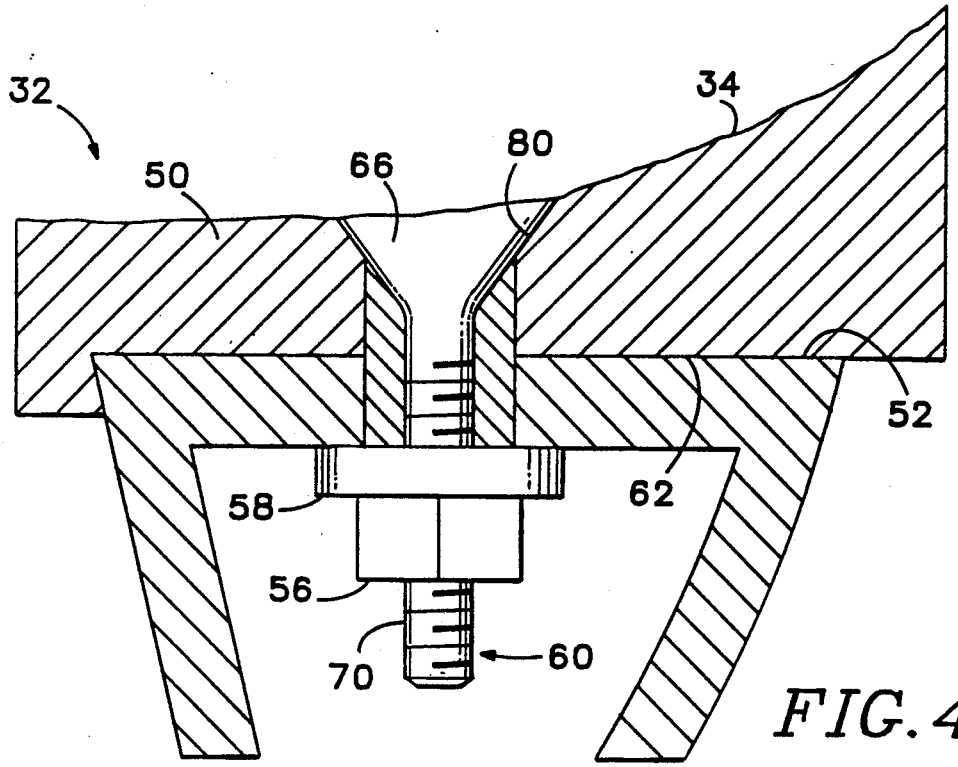
FIG. 4 is a view similar to FIG. 3 but with the bolt tightened and after a period of operation that has allowed wear to occur to the impeller block and bolt head.

After the crusher 10 has been in operation for some time, portions of the forward face 34 of each impeller block 50 will be worn away, as shown in FIG. 4, due to repeated impingement of these faces by the rocks being crushed. Despite this wearing process, the inner wall defining the enlarged cavity region 80 of the block protectively surrounds a sufficient portion of the enlarged head 66 of the elongate bolt 60 to keep the impeller block 50 retained against the upright mount 52. There is little risk, therefore, that the impeller block 50 will be suddenly thrown from the rapidly spinning turntable 16.

As indicated in dashed lines in FIG. 3, before the forward face 34 of the impeller block 50 has reached its spent condition depicted in FIG. 4, frequently a certain amount of play will develop between the block 50 and the bracket 54. This occurs because jarring of the block 50 can cause the nut 56 to vibrate loose to a partially disengaged position in which it is backed off from its fully tightened position on the bolt 60 by a distance 84. When the block to bracket connection has loosened, it is desirable to temporarily halt operation of the crusher 10 and to retighten the connection so as to prevent knocking of the block 50 against the pin 60 and the bracket 54.

Viewing FIGS. 1, 3, and 5 together, tightening of the connection between the block 50 and bracket 54 is facilitated by the radially asymmetrical shape of the wedge section 74 of the head portion 66 of the bolt, together with the complementary shape of the enlarged cavity region 80. During operation of the crusher 10, there is a tendency for smaller particles of rock to collect, in closely-packed arrangement, in the mouth of the enlarged cavity region 80. This potentially can make tightening of the nut 56 on the bolt 60 a laborious task, particularly if these rocks must first be pried loose from the cavity region 80 to provide access to the head 66 of the bolt. With the present invention, this difficulty is overcome, however, by the radially asymmetrical configuration of the wedge section 74 and of the cavity region 80. These elements cooperate to prevent rotation of the bolt 60 within the bore 78, when the nut 56 is turnably engaged with the threaded portion 70 of the bolt, despite a lack of access to the head portion 66 of the bolt.

The block 50 experiences a limited amount of knocking in the interval between when the nut 56 backs off slightly from its fully tightened position and when the operator notices this development and stops the crusher 10 in order to retighten the connection. Divided into its component parts, this knocking can occur either in an axial direction perpendicular to the upright mounting face 52 of the bracket 54, or in a lateral direction parallel to the upright mounting face. As shown in FIG. 3, the degree of axial knocking that can occur depends on the forward play 82 available between the block 50 and the mounting face 52. This, in turn, is limited by the relatively small distance 84 over which the nut 56 is permitted to loosen before being retightened. (The absolute distances indicated by the converging arrows in FIG. 3 have been exaggerated somewhat for ease of illustration.) This limitation on the freedom of travel of the block 50 before impact serves to limit the forces that are experienced by the block upon impact.

Because of the tapered section 76 (refer to FIG. 5) included on the head portion 66 of the bolt, the degree of lateral knocking similarly is limited by the relatively small distance 84 over which the nut 56 is permitted to loosen before being retightened. More specifically, starting from a position as shown in FIG. 3, where the bolt 60 is centered in the bore 78 of the block 50, upon movement of the block in a lateral direction 86, the block will impact the bolt 60 after travelling a distance 88, and the block and bolt, moving together, will impact the sides of the opening 64 on the bracket 54 after travelling a distance 90. The distance 90 depends on the difference in radius between the bore 78 and bolt 60 and therefore is outside the control of the operator, but the distance 88, due to the 45° angle at which the tapered section 76 converges toward the constant diameter shank portion 70, equals the forward play 82 and therefore can be minimized by minimizing the distance 84 over which the nut 56 is permitted to loosen before being retightened. For this reason, and also because the overall lateral play available equals the sum of the distances 88 and 90 irrespective of the starting position of the bolt 60 relative to the bore 78, for the preferred impeller assembly 32 shown in FIG. 3, the overall lateral play available can be incrementally minimized by minimizing the maximum distance 84 that the nut 56 backs off from the bolt 60 before being retightened. In contrast, if the head portion 66 were to be "squared-off" instead of tapered, the overall lateral play available could not be adjusted by the operator but instead would partially depend on the closeness of fit achieved between the squared-off bolt head and a correspondingly modified cavity region. This fit, as with the "fit" 90 achieved between the constant diameter shank portion 70 and bore 78 would, on average, be relatively oversized because of the above-described difficulty in forming each block 50 to precise dimensions.

Referring to FIGS. 3 and 5, the tapered section 76 included on the head portion 66 of the bolt 60 further serves a bolt centering function so that the constant diameter shank portion 70 of the bolt is retained in spaced-apart relation to the bore 78 formed in the block 50 despite movement being possible between the block 50 and the upright mounting face 52 because of partial disengagement of the nut 56 and despite subsequent glancing movement of the block 50 in a lateral direction 86 toward the bolt. Stated alternatively, the block 50 is restricted in the distance it can travel before impacting the bolt 60 insofar as it can approach no closer to the constant diameter shank portion 70 than the difference between the respective distances 90 and 88, rather than being able to travel over the full distance that separates it from the constant diameter shank portion 70. Accordingly, since its range of travel before impact with the bolt 60 is limited, the forces that are experienced by the block 50 during such impact are also limited.

It will be recognized that certain modifications can be made to the preferred embodiment of the impeller assembly 32, which is herein shown and described, without departing from the broader principles that underlie the present invention. For example, the head portion 66 of the elongate bolt 60, rather than being formed as a unitary whole, may be formed as a sequence of longitudinally-spaced, laterally-extending cross arm portions. Furthermore, the advantages heretofore described can be obtained with the invention regardless of whether the wedge section 74 of the bolt is flattened, as shown in FIG. 5, or whether, instead, is made rectangular or even broadly elliptical in profile. Moreover, it is not essential to the wedging function that the head portion 66 have a tapered section.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. Apparatus for mounting an impeller to the horizontal rotatable table of a centrifugal impact rock crusher, comprising:

(a) an impeller having a wear surface that contacts uncrushed material placed on the turntable and directs said material radially outwardly across the turntable, and an opposed mounting surface;

(b) said impeller defining a bore extending between said wear surface and said mounting surface;

(c) a mounting bracket attached to the turntable and having an upright mounting face that abuts said mounting surface, said mounting bracket defining a hole that is aligned with said bore;

(d) an elongate bolt having a cylindrical threaded portion with a central axis and a head portion, said head portion being outwardly flared extending away from said threaded portion and being radially asymmetrical about said central axis; and (e) said impeller defining an enlarged cavity in communication with said wear surface, said cavity being arranged to snugly receive said head portion completely within said impeller with said threaded portion extending through said hole, and prevent rotation of said bolt when a nut is placed on said thread portion and tightened against said mounting bracket.

2. The apparatus of claim 1 wherein said head portion defines a closed curve on any cross section thereof perpendicular to said central axis.

3. The apparatus of claim 1 wherein said cavity is sized such that all of said head portion is offset inwardly into said impeller from said wear surface.

4. The apparatus of claim 3 wherein said wear surface is planar.

* * * * *

UNITED STATES PATENT AND TRADEMARK OFFICE

CERTIFICATE OF CORRECTION

PATENT NO. : 5,137,220

DATED : August 11, 1992

INVENTOR(S) : Brett M. Rose, William F. Burr, Stephen B. Ackers

It is certified that error appears in the above-identified patent and that said Letters Patent is hereby corrected as shown below:

Col. 1, Line 38: after time delete "a" insert --as--

Col. 8, Line 18: delete "thread" insert --threaded--

Signed and Sealed this

Nineteenth Day of October, 1993

Bruce Lehman

*Attest:*

BRUCE LEHMAN

*Attesting Officer*

*Commissioner of Patents and Trademarks*